United States Patent [19]

Paulson

[11] Patent Number: 4,986,522

[45] Date of Patent: Jan. 22, 1991

[54] PRINTING PRESS FEED MECHANISM

[76] Inventor: Harold E. Paulson, 360 Wynland Trace, Dunwoody, Ga. 30350

[21] Appl. No.: 413,435

[22] Filed: Sep. 27, 1989

[51] Int. Cl.[5] ..... B65H 3/10

[52] U.S. Cl. ..... 271/2; 271/5; 271/9; 271/99; 271/108; 271/107

[58] Field of Search ..... 271/99, 107, 108, 2, 271/9, 100, 5, 6

[56] References Cited

U.S. PATENT DOCUMENTS

| | | | |
|---|---|---|---|
| 3,834,691 | 9/1974 | Paulson | 271/108 X |
| 4,121,819 | 10/1978 | Di Francesco | 271/108 X |
| 4,583,729 | 4/1986 | Blumle | 271/108 X |

*Primary Examiner*—Richard A. Schacher
*Attorney, Agent, or Firm*—Jacobson and Johnson

[57] ABSTRACT

A device for feeding envelopes or similar work pieces to a printing press or the like utilizes a vacuum chamber mounted on a reciprocably driven roller for removing the lowermost envelope out of a stack of envelopes in a hopper and advancing it to a carrier for conveyance to the printing press. The vacuum is fed to the vacuum drum through an elongated passageway along the axis of the roller and a valve at the input of the vacuum at one end of the roller reciprocates with the roller to open and close the vacuum passageway. Also, a pusher lug is provided to assist in removing heavier stock from the hopper.

9 Claims, 9 Drawing Sheets

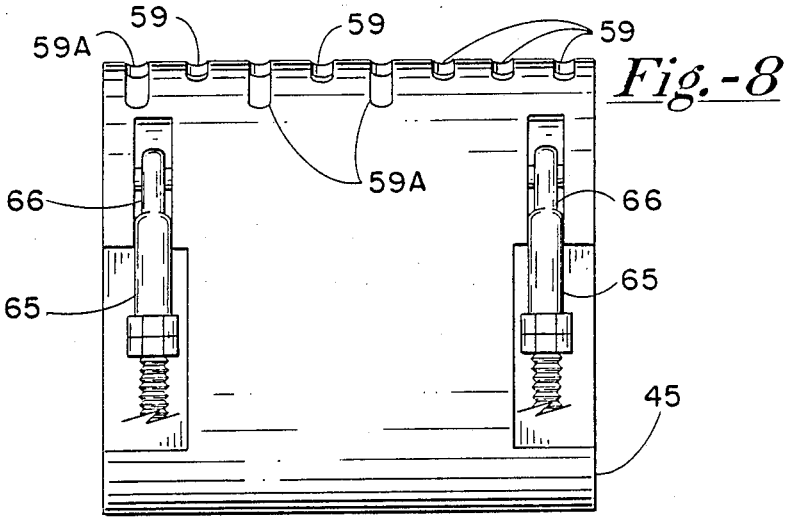
Fig.-8
Fig.-9
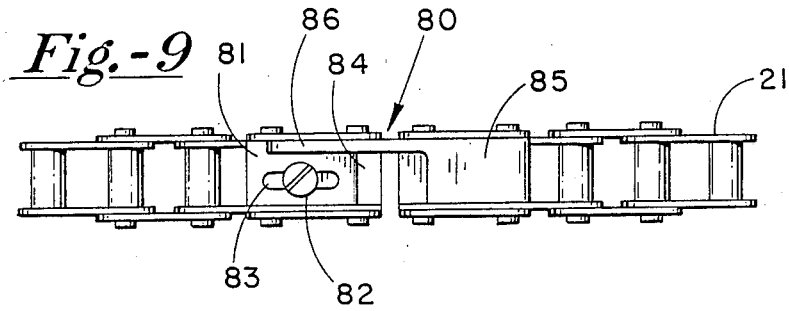
Fig.-10
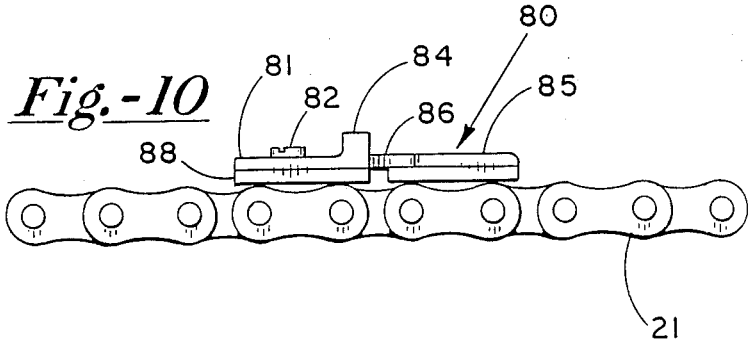
Fig.-11
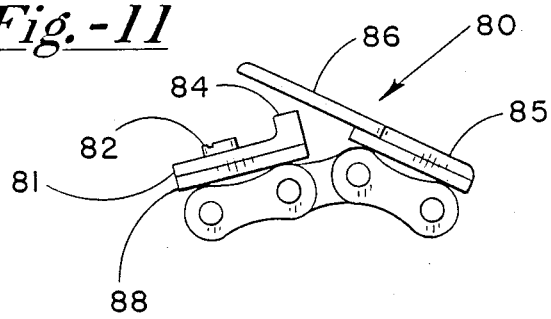

PRINTING PRESS FEED MECHANISM

FIELD OF THE INVENTION

This invention is directed toward feeding mechanisms which utilize a reciprocably rotating vacuum drum for removing individual envelopes or similar work pieces from a stack of envelopes in a hopper and feeding them one at a time to an endless belt or chain carrier for delivery to a printing press.

DESCRIPTION OF THE PRIOR ART

My U.S. Pat. No. 3,834,691 describes a feeder for envelopes stacked in a main hopper with the feeder utilizing a reciprocating vacuum drum mounted on a shaft for reciprocably applying a vacuum to the underside of the bottommost envelope in the hopper to pull it out of the hopper and advance it toward a carrier which then conveys it to a printing press or the like. Vacuum from a suitable source is fed to a manifold located adjacent the vacuum drum and vacuum communication between the manifold and the drum is established via openings or ports between the adjacent side walls of the drum and the manifold which open and close as the drum is rotationally reciprocated. At what might be considered the starting position of the drum, peripheral openings in the vacuum drum, i.e., openings through the outer surface wall of the drum, allow the vacuum to be applied to the underside of the lowermost envelope in the hopper near its leading edge to pull it down and as the vacuum drum is rotated in a forward direction, it pulls or carries the envelope out of the stack between feeder wheels which then take over to direct the envelope to an endless belt or chain carrier which conveys it to the printing press. The vacuum drum then rotates in a reverse direction back to its initial start position to pick up the next envelope and direct it toward the carrier in the same fashion. In the '691 device, when the vacuum drum rotates far enough in a forward direction until the envelope is grasped by the feeder wheels, the vacuum path from the manifold to the vacuum drum closes and since the manifold and drum are immediately adjacent one another, the vacuum is immediately removed from the vacuum drum and all suction on the envelope disappears. In the case of windowed envelopes stacked in a hopper with the envelope flap down and the flap edge being the leading edge, when the bottom envelope is pulled out of the hopper an edge of the window area may catch on the edge of the flap of the next envelope in the stack with disastrous results.

In the '691 feeding device the feed wheels which deliver the envelope from the vacuum drum to the conveyer or carrier comprise a pair of undriven wheels on an auxiliary shaft frictionally cooperable with a corresponding pair of driven wheels (referred to as disks in the '691 patent) on the main feeder shaft. The envelope is grasped between the two sets of wheels and is directed to or delivered to an endless chain carrier for conveyance to the printing press. As described in the '691 patent, when an auxiliary hopper is used, the auxiliary shaft with its feed wheels must be removed in order to install the auxiliary hopper and its associated feeder roller.

As mentioned in the '691 patent, an auxiliary or upper hopper with associated vacuum feed roller is generally utilized with lightweight envelopes, or similar work pieces, and a main or lower hopper and associated vacuum feed roller and drum is utilized for intermediate and heavier weight envelopes. The '691 patent points out that the feed table on which the main hopper is mounted can be swung to different angles to accommodate different weights of envelopes, even up to a generally horizontal position for the heaviest weighted envelopes. Even with this capacity and flexibility, it has been found that in those cases where the envelopes or work pieces are quite heavy the vacuum alone may not be enough to consistently and reliably remove the envelopes or work pieces one at a time from the bottom of a stack so some additional assistance in the form of a pusher lug may be needed.

SUMMARY OF THE INVENTION

The instant invention basically operates in the same fashion as the '691 device, i.e., a vacuum drum is mounted on a roller just below and in close proximity to the underside near the leading edge of the lowermost envelope of the stack of envelopes in a hopper and the roller along with the drum is reciprocably rotated from its starting position in a first direction to draw the lowermost envelope out of the hopper and direct it to a set of feed wheels which carry the envelope to a carrier for conveyance to a printing station and then in a reverse direction back to the starting position to get ready to remove and advance the next envelope from the bottom of the hopper. Unlike the '691 patent where the vacuum source is immediately adjacent the vacuum drum, in the instant invention the vacuum drum is in vacuum communication with the vacuum source via radial openings into the drum interior from an elongated vacuum passageway extending along the axis of the roller or the roller shaft which is attached at one end through suitable valving means to a suitable vacuum source. In this fashion even when the valving means closes off the vacuum applied to the roller vacuum passageway, there is residual vacuum still present in the roller vacuum passageway and at the vacuum drum so that some degree of vacuum is continually applied to the envelope by the drum to provide some suction on the envelope to help the edge of the window area of the envelope being removed clear the edge of the flap of the next-to-be-removed envelope in the stack. Also, the vacuum is applied uniformly across the envelope being removed. Additionally, the openings in the vacuum drum are elongated slots, some being longer than others, so that the vacuum is applied to the envelope over a greater range than in the past to also help prevent a handup between the trailing edge of the window of the envelope being removed and the flap of the next envelope.

As in the '691 patent, the instant feeding device also has provisions for an auxiliary or upper hopper with associated feed roller. The feed wheels on the auxiliary feed rollers for use with the auxiliary hopper are free to rotate about the axis of the auxiliary feed roller and are rotated by direct surface-to-surface contact with the corresponding driven feed wheels on the main feed roller or by an envelope or workpiece passing between the two sets of feed rollers. This eliminates the need for a third auxiliary shaft and feed wheels such as found in the '691 device.

As a further feature, particularly for heavier envelopes or workpieces, pusher lugs may be provided for engaging or contacting the trailing edge of the lowermost envelope in the hopper stack with means for operably reciprocating the pusher lugs at the same rate as the feed roller to push against the trailing edge of the envelope to assist in removing the bottom envelope from the stack and directing it to the carrier.

BRIEF DESCRIPTION OF THE DRAWING

FIG. 8 is a view illustrating linkage of a pusher lug mechanism to a vacuum drum;

FIG. 9 is a top plan view of a preferred embodiment of a carrier lug;

FIG. 10 is a side elevational view of the carrier lug of FIG. 9;

FIG. 11 is a side view illustration of the same carrier lug operative to release the envelope from the carrier;

DESCRIPTION OF THE PREFERRED EMBODIMENTS

Figure 1:
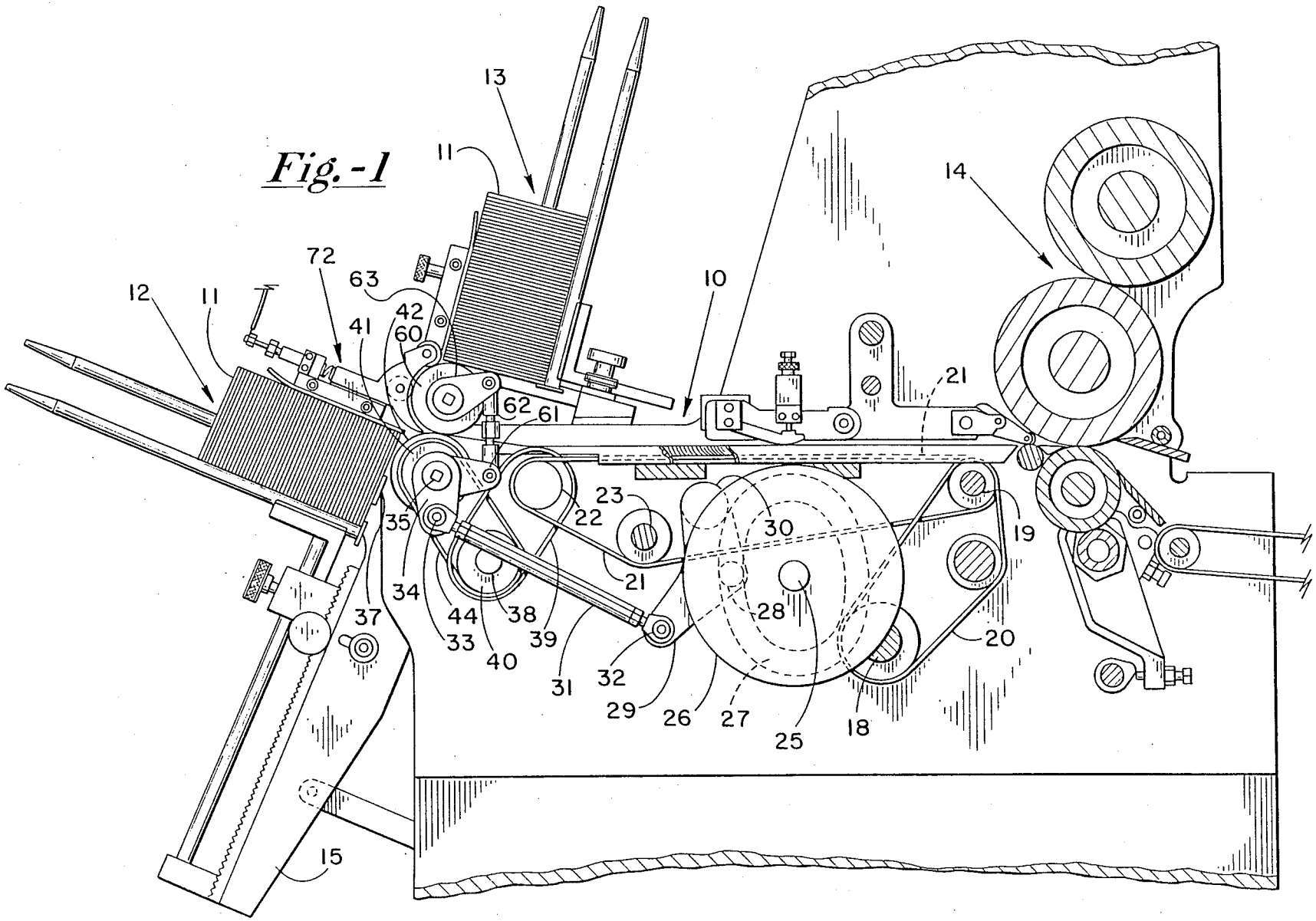
FIG. 1 is a side view of an apparatus incorporating an embodiment of the invention.

A main support structure or frame, generally designated by reference numeral 10, supports a series of shafts having pulleys or sprockets or the like mounted thereon, which will be described later, to provide the driving mechanisms to remove flat workpieces or envelopes 11 (hereinafter usually referred to as envelopes) one at a time from a stack in a main hopper 12 or in an auxiliary hopper 13 and carry them to a printing press generally designated by reference numeral 14. Hopper 12 which is mounted on feed table 15, is described in the '691 patent and does not constitute a novel aspect of the present invention so will not be described in detail. Hopper 12 may be referred to from time to time as the main or lower hopper. Envelopes 11 are stacked in main hopper 12 flap side down with the flap edge as the leading edge of the envelope as it is removed from the hopper. Auxiliary or upper hopper 13 is similar to main hopper 12 and is also described in the '691 patent and does not constitute a novel aspect of the instant invention. The envelopes 17 in hopper 13 are stacked flap side up with the flap edge as the leading edge of the envelope as it is withdrawn from the hopper. Also, as mentioned in the '691 patent, feed table 15 is hingedly attached to frame 10 so that hopper 12 can be adjusted to some limited degree. However, once the hopper is set, it is locked in place for the batch of envelopes. In general hopper 12 is at an angle such that the envelopes are at an angle of about seventy-five degrees with respect to the horizontal as illustrated in FIG. 1. Also, conventionally the feed table is equipped with rollers to enable the envelopes to slide freely on the table and also has means for adjusting the size of the hopper to accommodate envelopes of different sizes. Typically, auxiliary hopper 13 is used for lightweight envelopes and the main hopper 12 is used for medium and heavyweight envelopes. The use of hoppers 12 and 13 are mutually exclusive, i.e., if one is being used the other is not being used. However, as will be later described, the feeder wheels on the rollers associated with each of the respective hoppers operate together. Printer 14 also does not constitute a novel part of the instant invention and so will not be described in any detail. Suffice it to point out that typically the envelopes 11, or other work pieces, are continuously delivered in tandem to the printing press 14 with the flap side down.

A main power shaft 18 is rotationally driven by a main power source such as an electric motor, not shown, and in turn rotationally drives carrier drive shaft 19 via belt or chain 20. Shaft 19 drives an endless chain or belt carrier 21 via pulleys or sprockets 22 and 23 in a fashion to provide an endless belt carrier in the same manner as in the '691 patent. Endless chain or belt 21 carries spaced carrier lugs, not shown in FIG. 1 but which will be described later, and as the envelopes are withdrawn singly from one of the hoppers 12 or 13 they are delivered to and deposited on carrier belt 21 and are moved along by the carrier lugs and are conveyed downstream to the printing press 14.

In some conventional fashion, which is a matter of choice, main power shaft 18 also rotationally drives cam shaft 25 to continually rotate cam plate 26 which has a cam slot 27 on its surface engaged by cam pin or cam follower 28. Bell crank lever or arm 29 is attached to cam follower 28 and is pivotably attached at one end to frame 10 at 30. An adjustable length link 31 is pivotably attached at one end to the other end 32 of bell crank arm 29 and at its other end 33 is pivotably attached to lever arm 34 mounted on shaft 35 of main feed roller 37 for reciprocably rotating main feed roller 37 about its axis. The shaft of pulley 22 has another pulley or sprocket mounted on it, not shown, which rotationally drives shaft 38 via belt or chain 39 and pulley 40.

Coaxially mounted on shaft 38 are a pair of spaced-apart sprockets or pulleys 43 (FIG. 3) which are drivably coupled via belts or chains 44 to sprockets 41 which are attached to knurled feeder wheels 42 on each side of a vacuum drum 45. Feeder wheels 42 and sprockets 41 are suitably mounted on bearings, not shown, on feed roller shaft 35 so they are free to rotate with respect to shaft 35 and vacuum drum 45. Vacuum drum 45 is attached to shaft 35 by screws, not shown, in threaded openings 36. As vacuum drum 45 reciprocably rotates with shaft 35, feeder wheels 42 are continuously rotated in one direction, clockwise as observed in FIG. 1, by shaft 38 sprockets 43 and chains 44.

Figure 3:
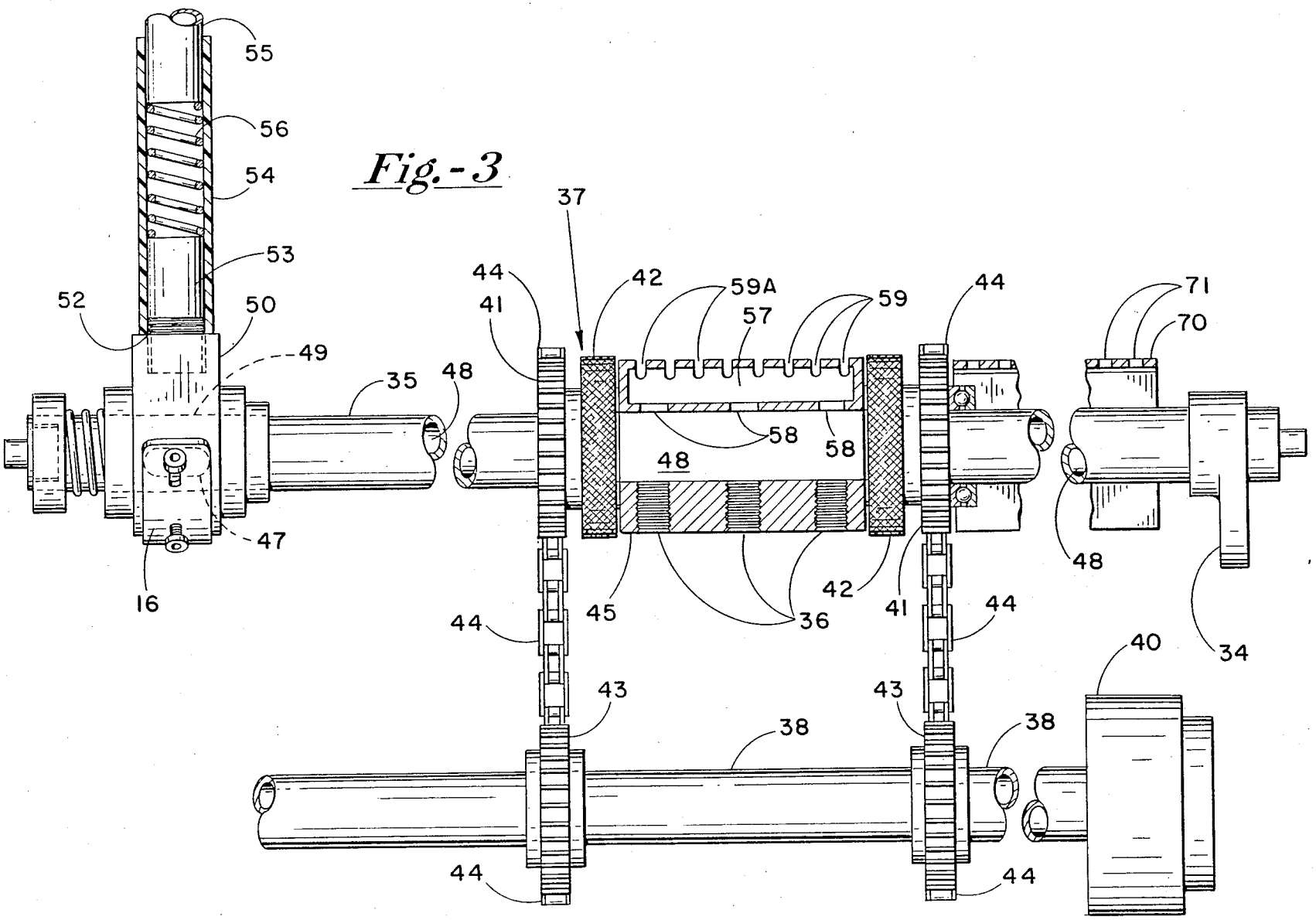
FIG. 3 illustrates in detail a main feed roller utilized in an embodiment of the invention.
Figure 4:
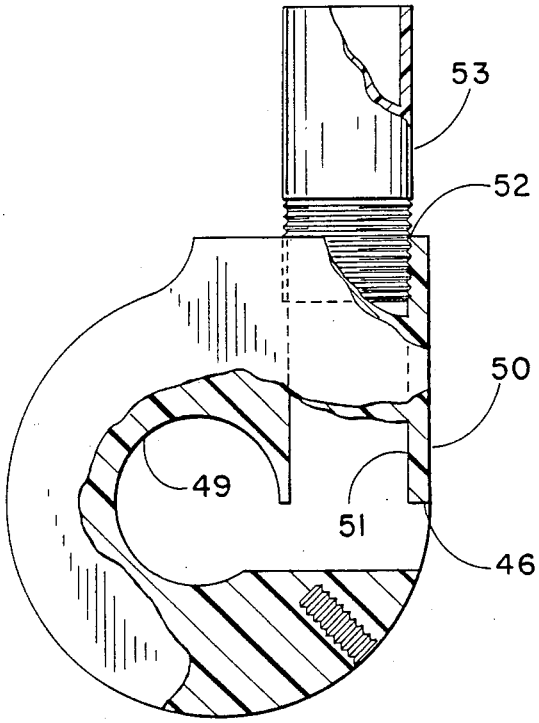
FIG. 4 is a side elevational view of the vacuum valving mechanism utilized in a preferred embodiment of the invention.
Figure 5:
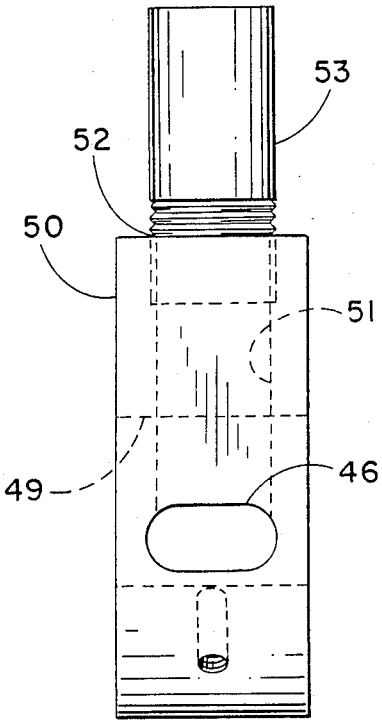
FIG. 5 is a top plan view of the valving mechanism of FIG. 4.
Figure 6:
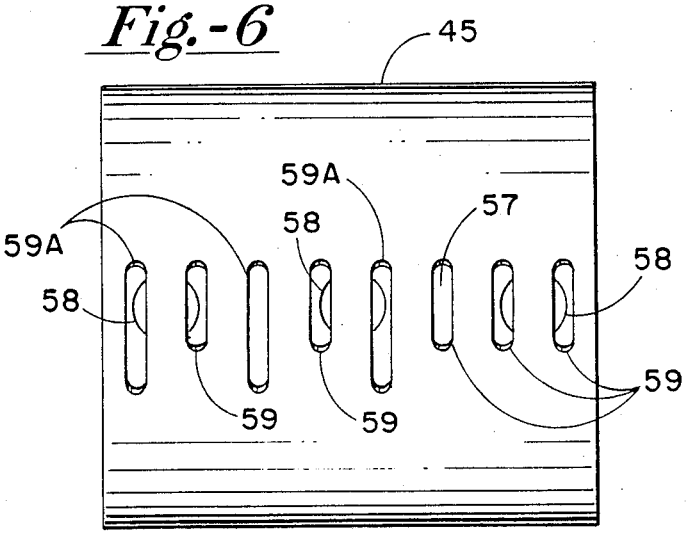
FIG. 6 is a top plan view of the vacuum drum.

Shaft 35, as best seen in FIG. 3, has an axial hollow bore 48 which is closed off at each end of the shaft. Near the end of the shaft opposite from its attachment to lever arm 34 shaft 35 rotatably passes through bore 49 in housing 50 which is attached, by means not shown, to frame 10 or other supporting structure. As shown more clearly in FIGS. 4 and 5 housing 50 has an inner passageway 51 with a vacuum inlet port 52. A nylon bushing 53 is threaded into inlet port 52 and at one end a flexible nylon sleeve 54 is fitted over bushing 53. At its other end sleeve 54 is fitted over another bushing 55 which extends beyond sleeve 54 and is coupled, by means not shown, to a suitable vacuum source, not shown. Between bushings 53 and 55 is a helical spring 56 which counteracts the forces produced when the vacuum is cut off thereby allowing the shaft to rotate back and forth freely with respect to housing 50. Passageway 51 is in communication with bore 49 via a radial slotted opening 46. Within the area of bore 49 shaft 35 has a similar radial slotted opening 47 in communication with hollow bore 48. As shaft 35 is reciprocably rotated by lever arm 34, slotted opening 47 is rotationally positioned so that it ranges from directly facing slotted opening 46 to housing passageway 51, at which point vacuum communication is totally open between the vacuum source and shaft bore 48, to a position where the shaft slotted opening 47 is closed off from vacuum communication with bore slotted opening 46, thereby closing off passage of vacuum from the source to shaft bore 48. The former can be considered to be a first rotational extreme position of shaft 35 and the latter can be considered to be the second extreme position of shaft 35. In this fashion, then, as shaft 35 and roller 37 are reciprocably rotated between a first extreme position and a second extreme position, correspondingly the vacuum communication between the vacuum source and bore 48 ranges between fully open to fully closed, with intermediate degrees in between.

Slotted opening 46 can be extended all the way through housing 50 to the atmosphere and covered over with a curved plate 16 held in place by set screws through elongated holes in plate 16. Normally plate 16 is positioned to totally cover over the opening but, if necessary, the plate can be adjusted to partly open the opening to the atmosphere to bleed off some vacuum.

Cylindrical vacuum drum 45 is coaxially mounted on shaft 35 so that it reciprocably rotates therewith. Vacuum drum 45 has a hollow interior chamber 57 which is in vacuum communication with bore 48 of shaft 35 via a series of radial openings 58 thereby making the vacuum uniform in the drum, and has a series of axially spaced-apart slotted openings 59 through its outer wall. Some of the slots, 59A, are longer than others, the purpose for which will be described later. Preferably the outer periphery of knurled feeder wheels 42 is slightly beyond the outer periphery of drum 45 to make sure that after an envelope leaves the hopper it will contact the knurled feeder wheels 42 which will then advance the envelope to the carrier. For clarity this difference may not be shown in some or all of the drawings.

Referring back to FIG. 1 and FIG. 2, auxiliary feed roller 60 associated with auxiliary hopper 13 is axially parallel to and located just above main feed roller 37. Auxiliary feed roller 60 is very similar to feed roller 37. Feeder wheels 42 on auxiliary feeder roller 60 are free to rotate with respect to its vacuum drum 45 and its hollow-bore shaft 96, but they are not separately driven. Feeder wheels 42 on auxiliary roller 60 are cooperable with feeder wheels 42 on roller 37 by tangential contact therewith and/or by an envelope passing between the two sets of feeder wheels so that frictional engagement causes feeder wheels 42 of the auxiliary feed roller 60 to rotate. Lever arm 61 is attached at one end to shaft 35 of main feed roller 37 and at its other end is pivotably attached to one end of an adjustable link 62 which is pivotably attached at its other end to another lever arm 63 which is attached to shaft 96 of auxiliary feed roller 60 whereby auxiliary feed roller 60 is reciprocably rotated between two extreme positions along with main feed roller 37.

Figure 2:
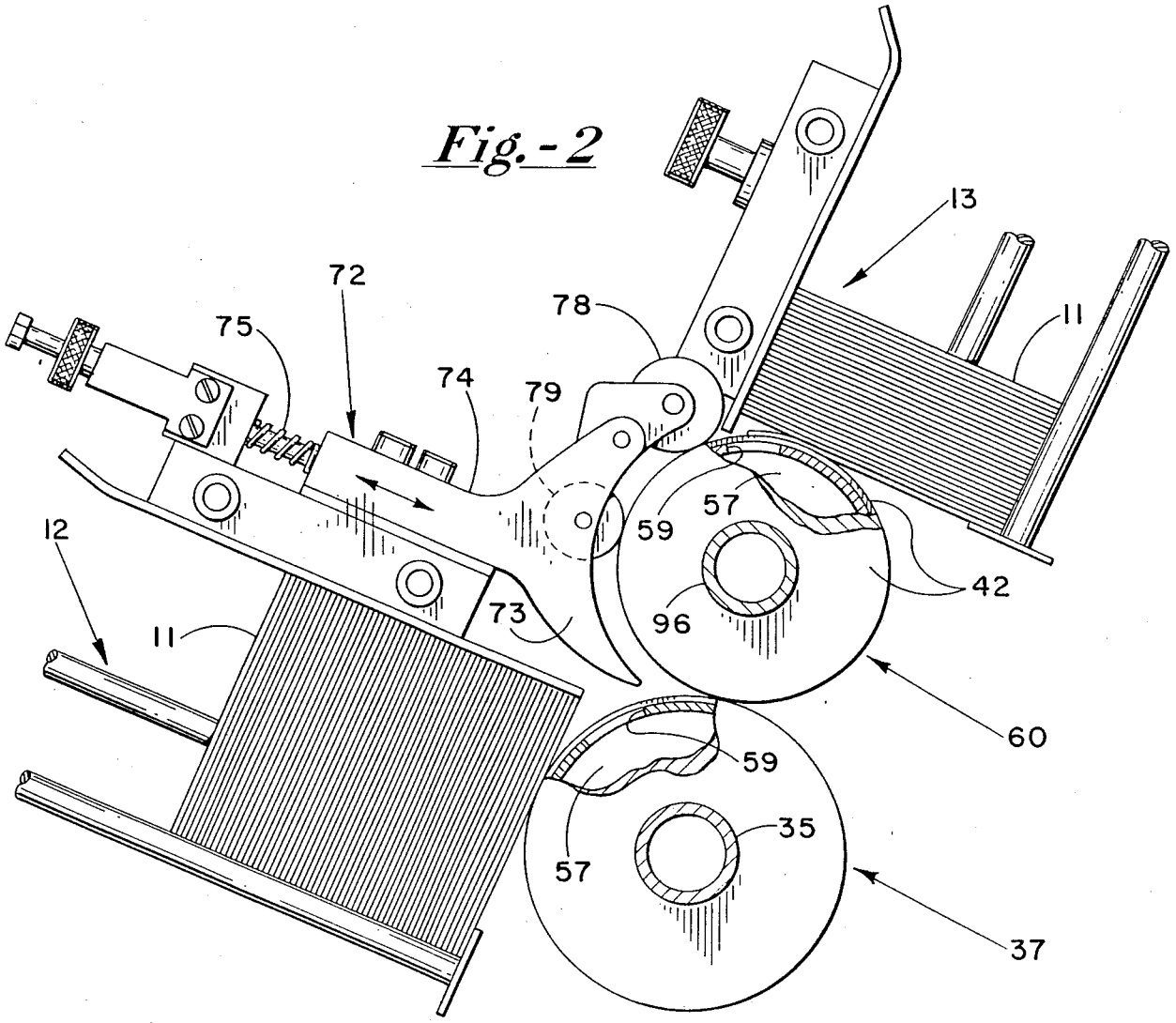
FIG. 2 is a somewhat enlarged view illustrating in greater detail the construction and function of an embodiment of the invention.

In general, the operation of the vacuum drum and associated feeding mechanism to remove envelopes one at a time from the stack in hoppers 12 or 13 and deliver them in tandem to carrier 21 is similar to the '691 machine. Starting at the first extreme position of the main feed roller 37, as illustrated in FIG. 2, maximum vacuum is applied via passageway 51, bore 48 and vacuum drum 45 from the vacuum source to the lowermost envelope in the stack of hopper 12 to suck down the leading edge of the lowermost envelope onto the vacuum drum 45 and feeder wheels 42. As shaft 35 and roller 37 rotate forwardly, clockwise as viewed in FIG. 2, the combined rotation of drum 45 and feeder wheels 42 slide the envelope out of hopper 12 and by the combination of the vacuum suction applied to the envelope and the continuous rotation of feeder wheels 42, the leading edge of the envelope is carried between the feeder wheels 42 of rollers 37 and 60 and is thereby directed and delivered to the continuous moving carrier belt or chain 21. As vacuum drum 45 continues rotation toward its second extreme position, as determined by cam plate 26 and slot 27, the vacuum at drum 45 which is applied to the envelope is reduced by the action of the valving in the vacuum passageway 51 of housing 50. However, because of the length of the vacuum passageway from the vacuum source through bore 48 of shaft 35 to vacuum drum 45 the change is quite gradual so even though the vacuum diminishes there is some significant degree of suction present. This, coupled with the longer slots 59A in drum 45 results in vacuum being applied to the trailing part of the removed envelope to suck it down onto the drum and feeder wheels so that if the envelopes are windowed, the edge of the window on the envelope being removed will avoid the edge of the downfacing flap on the next envelope in the stack. Even when the feeder roller 37 reaches its second extreme position, where the vacuum communication from the source to bore 48 is completely closed off, there is some residual vacuum remaining in the bore of shaft 35 and through the vacuum chamber of drum 45 to further assist in keeping the lowermost envelope from catching on to the next envelope in the stack. As roller 37 is rotated back, or counter-clockwise as viewed in FIG. 2, from its second extreme position toward its first extreme position the vacuum passageway from the vacuum source to the vacuum drum starts opening wider but by then the feeder wheels 42 have taken control of delivering the removed envelope onto the carrier so that even though there may be an increase in the vacuum applied by drum 45 to the removed envelope, it does not interfere with the delivery of the removed envelope to the carrier. The various mechanisms and linkages are adjusted and the cam surface is designed such that the feeder roller returns to its first extreme position just as the trailing edge of the removed envelope passes out of the hopper so that the leading edge of the next envelope is immediately sucked down onto the vacuum drum and feeder wheels and advanced or delivered to the carrier in the same fashion as described earlier so that the envelopes are delivered one after another in tandem and with little wasted dwell time. On the outer side, the side away from drum 45, of each of the feeder wheels 42 of main feed roller 37 are stationary half-moon shaped skid plates 70, only one shown in FIG. 3 for clarity. Skid plates 70 support the outer edges of the envelopes as they are removed from hopper 12. The removed envelopes slide over skid plates 70 as they are directed to the carrier. Perforations 71 through plates 70 allow air through the skid plates so the envelopes will slide easily. Pressurized air, at a very low pressure, may be provided to the underside of the skid plates, by means not shown, to further insure that the envelopes will slide smoothly.

When auxiliary hopper 13 is being used, means, not shown, are provided to switch the vacuum from the vacuum source to the vacuum passageway coupled to the vacuum drum on the auxiliary roller 60. In general auxiliary roller 60 operates in the same fashion as main roller 37 to remove envelopes from its associated hopper 13 except that as viewed in FIG. 2 it reciprocates starting from its first extreme position, where the maximum vacuum is applied to pull down the leading edge of the lowermost envelope in hopper 13, then rotates counterclockwise to its second extreme position and then back clockwise to its starting position.

Figure 14:
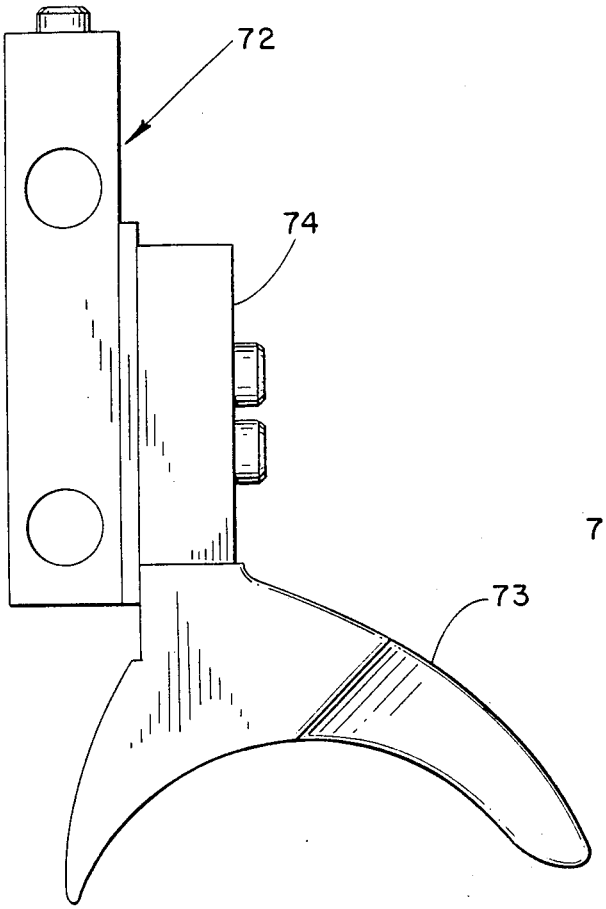
FIG. 14 is a side view of a guide bracket.
Figure 15:
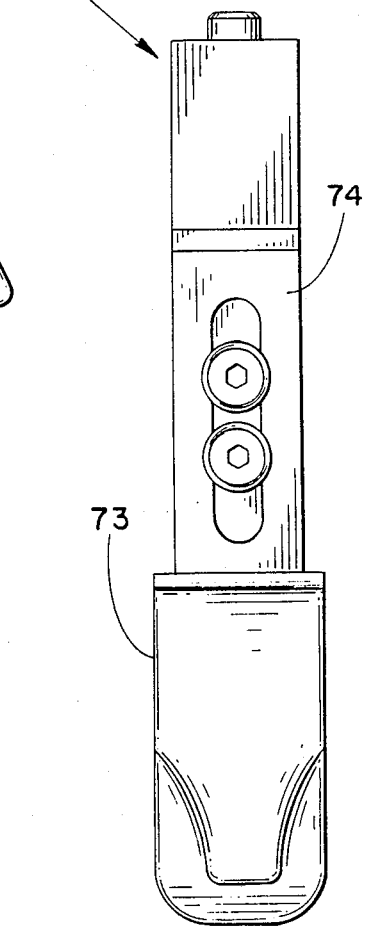
FIG. 15 is an end view of the bracket shown in FIG. 14.

Mounted to the frame by a cross-bar, not shown, are a pair of brackets generally designated by reference numeral 72, only one of which is shown in FIG. 2. Each bracket, shown in greater detail in FIGS. 14 and 15, has a half-moon shaped arcuate shoe 73 having generally the same radius of curvature as the feeder wheels 42 and facing the feeder wheels 42 on the auxiliary roller 60. An arm 74 of bracket 72 extends outward from the shoe 73. Attached to the end of shoe 73 which is closest to the hopper 13 is a freely rotatable spring-loaded pinch roller 78 which is adjusted to make contact with feeder wheel 42 on auxiliary roller 60. Mounted at about the center of shoe 73 is another spring-loaded freely rotatable pinch roller 79 which also is adjusted to make contact with its opposite facing feeder wheel 42. After the envelopes are removed singly from hopper 13 by the vacuum drum they are drawn between each of the rollers 78 and 79 and feeder wheels 42 of roller 60 to make a 180° turn. The lower end of shoe 73 continues to guide travel of the envelopes in the proper direction until they are engaged between feeder wheels 42 of auxiliary roller 60 and main roller 37 which then advances them to the carrier. Wheel or pinch roller 79 serves an additional function. It is attached to one end of a slideable spring tensioned rod 75 which is mounted in arm 74 of bracket 72 and the other end of rod 75 is adjacent an electrical switch, not shown. In the event more than one envelope at a time is removed from hopper 13 wheel 79 moves far enough so that rod 75 energizes the electrical switch which then turns off the machine to prevent damage which otherwise would occur if multiple envelopes are fed at the same time.

Figure 7A:
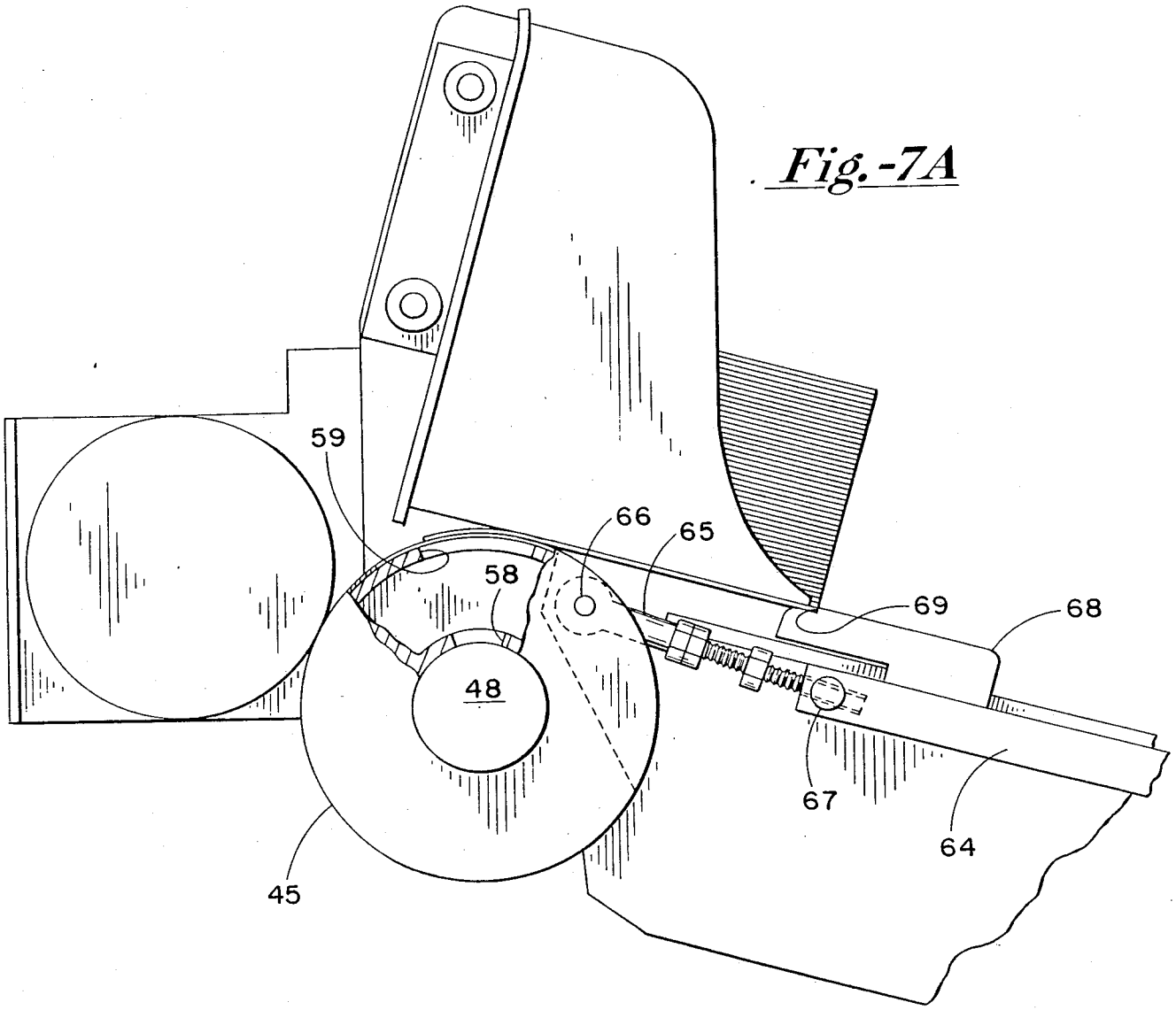
FIGS. 7A and B are side views of an embodiment of a pusher lug mechanism for use with the main feed roller shown at two different feeding positions.
Figure 7B:
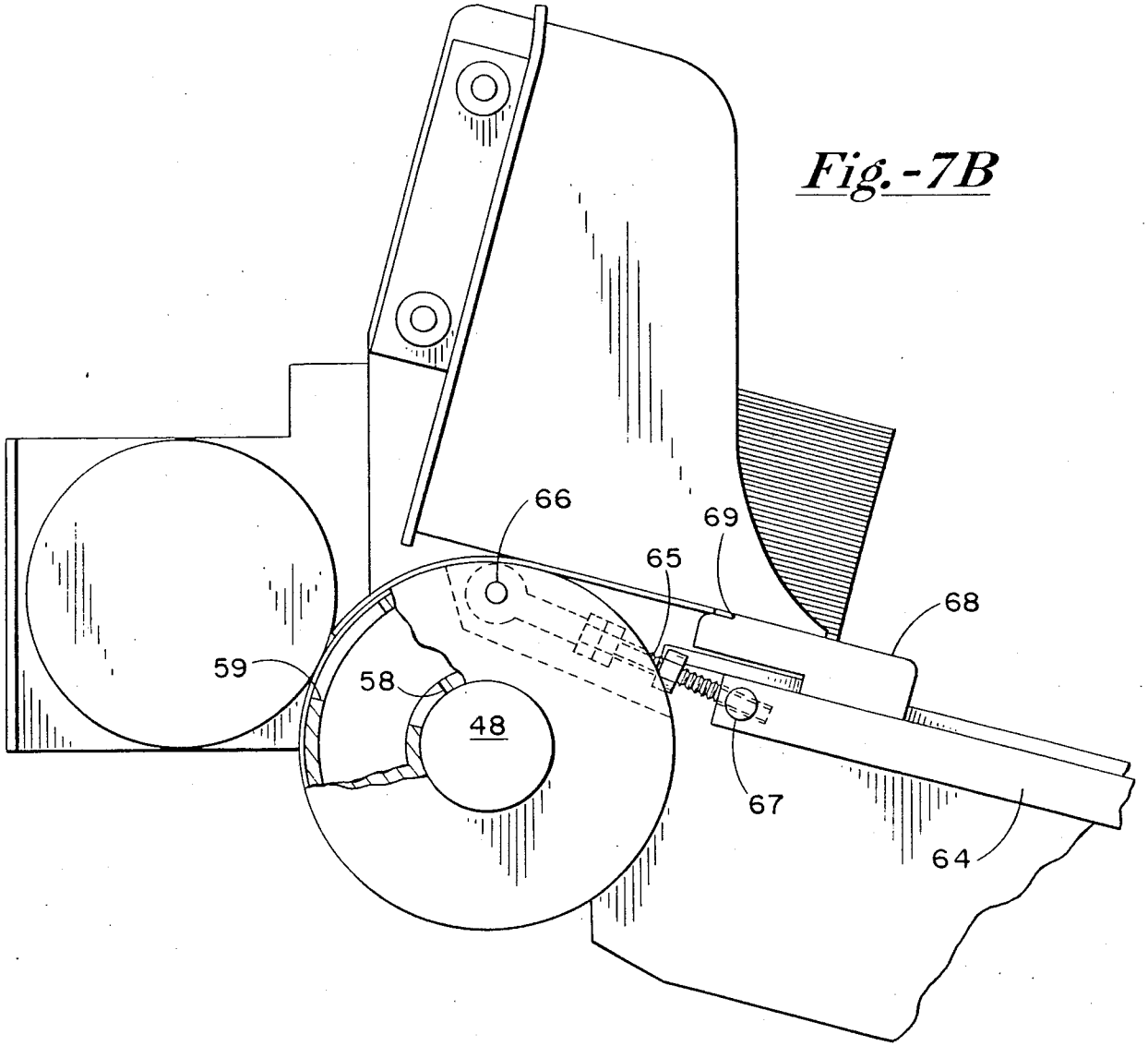

As mentioned earlier, in the case of relatively thick or heavy envelopes a pusher lug mechanism may be provided to assist the vacuum drum operation in removing the envelopes one at a time from the bottom of the main hopper 12. An embodiment of a suitable pusher lug and driving means is illustrated in FIGS. 7A and 7B. Adjustable linkage 65 may be pivotably attached at one end 66 to the exterior of vacuum drum 45 on main roller 37 (see FIG. 8) to reciprocate therewith. At its other end 67 linkage 65 is pivotably attached to slide bar 64 which is slidably mounted on frame 10 in some convenient fashion, not shown. Attached to the top of slider bar 64 is a pusher lug 68. Suitable adjustment screws, not shown, are provided for adjusting the location of pusher lugs 68 so that at the start its forward edge 69 just contacts the trailing edge of the lowermost envelope in the hopper. Via the described linking mechanisms, pusher lug 68 will slide back and forth with the reciprocating rotation of main feeder roller 37 and drum 45. Pusher lug 68 is located so that when roller 37 is at its first or initial extreme position, where the associated vacuum drum 45 is applying maximum suction on the leading edge of the lowermost envelope, the pusher lug leading edge 69 is contacting the trailing edge of the lowermost envelope in the hopper, see FIG. 7A. As roller 37 rotates toward its second extreme position, which would be counterclockwise as illustrated in FIGS. 7 and 7A, the leading edge or the front edge 69 of pusher lug 68 pushes the trailing edge of the lowermost envelope in the hopper while the vacuum drum and feeder wheels are directing the envelope towards the carrier, FIG. 7B. After roller 37 reaches its second extreme position and starts its return, clockwise as viewed in FIGS. 7 and 7A, pusher lug 68 slides underneath the next envelope in the hopper back to the starting position. The length of linkage 65 is adjustable so that the pusher lug can be set to the proper position to account for variations in sizes between batches of envelopes.

Figure 12:
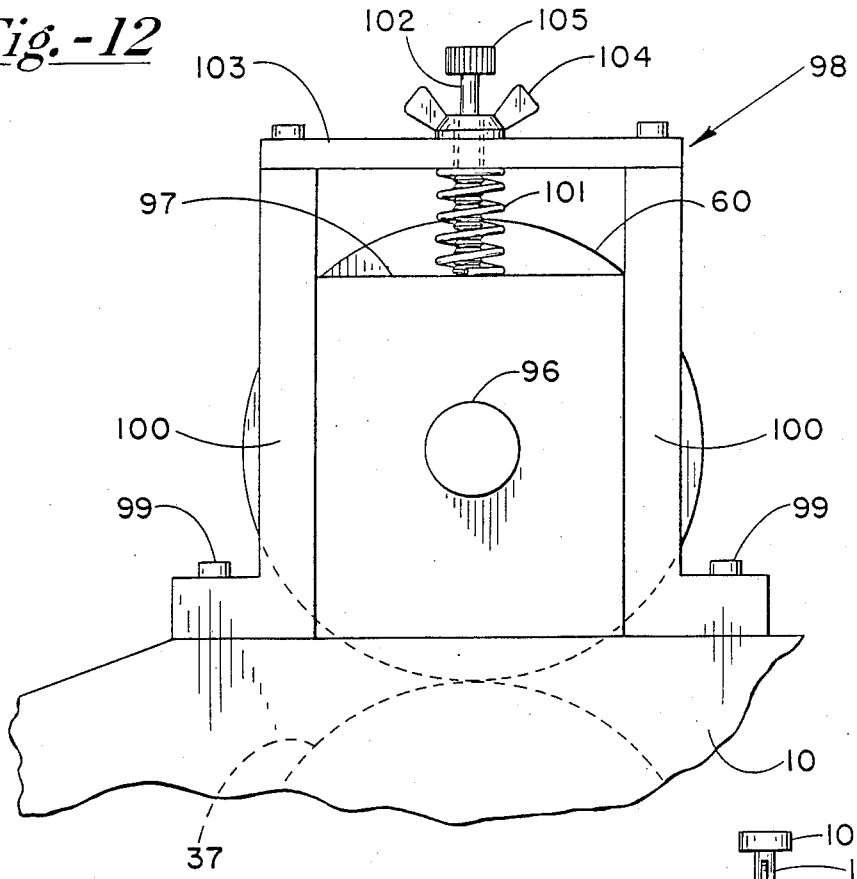
FIG. 12 is an end view illustration of the mounting mechanism for the auxiliary roller.
Figure 13:
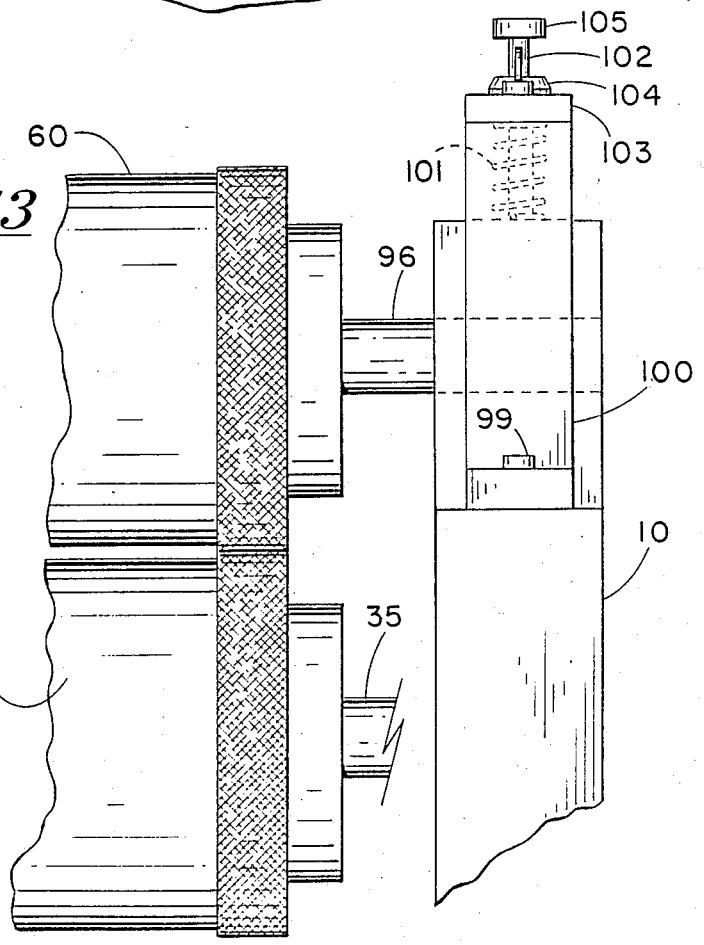
FIG. 13 is a side view of FIG. 12.

As illustrated in FIGS. 12 and 13, each end of shaft 96 of auxiliary roller 60 is mounted in a bearing block 97 which is held in place by a rectangular clamp generally designated by reference numeral 98. Although the arrangement is shown only for one end, it should be understood that the same arrangement is at each end of shaft 96. Clamp 98 is attached to main frame 10 by bolts 99, or in some other convenient fashion, and bearing block 97 is free to slide vertically within the confines of vertical arms 100 to allow some up and down movement of auxiliary roller 60. Helical compression spring 101 wrapped around rod 102 which is inserted through the top 103 of clamp 98 applies a downward force on bearing block 97. The tension of spring 101 can be adjusted by loosening wing nut 104 and turning rod 102 by its head 105 and when set to the proper tension can be locked by tightening wing nut 104. For illustration purposes only, main feed roller 37 is shown in shadow line form for describing the purpose of this mounting arrangement for auxiliary roller 60. In the event two or more envelopes are simultaneously withdrawn by main roller 37 from its hopper, when the two (or more) envelopes pass between the feeder wheels associated with main roller 37 and auxiliary roller 60 the auxiliary roller 60 will be moved upward (as illustrated in FIGS. 12 and 13) or radially away from main roller 37 by bearing block 97 moving slightly within the confines of clamp 98 a distance such that auxiliary roller 60 will press against roller 79 (see FIG. 2) so that the safety switch will be activated in the same manner as described earlier with respect to multiple envelopes being fed from auxiliary hopper 13 thereby immediately stopping the operation of the feeder to avoid problems which occur when multiple envelopes are fed together to carrier 21 and carried to the printer.

Carrier 21 comprises a pair of parllel spaced-apart link-type endless chains which are continuously driven at a suitable rate to deliver envelopes to the printer one at a time in relatively close relationship as they are removed one at a time from their hoppers. As illustrated in FIGS. 9 and 10, which shows only a portion of one chain but is the same for both chains, carrier lug assemblies 80 are mounted on carrier chain 21 in spaced relationship lengthwise to receive and transport each of the envelopes as it is removed from the hoppers. Carrier lug assembly 80 includes a first flat base member 88 mounted on a link of chain 21 in some convenient fashion with a second flat member 81 attached to base member 88 by threaded screw 82 through slotted hole 83 which provides for any slight adjustment that may be necessary. At one end of the flat member 81 is a post 84 which engages or contacts the trailing end of the envelope that is deposited on carrier 21 by the feeder wheels to advance it in the direction of travel of carrier 21, from left to right as illustrated in FIGS. 9 and 10. Mounted to the next forward link on carrier chain 21 is another flat member 85 having a rearward extending finger 86. Normally during the downstream travel of carrier 21 the envelope being pushed by post 84 rests on finger 86. As illustrated in FIG. 11, when the upper reach of carrier 21 reaches the end of its forward travel the chain starts to arc or curve and finger 86 raises to lift the rear end of the envelope away from post 84 to insure that it is properly fed to the printer and does not get hung up against post 84. Means, not shown, are provided so that the carrier lug assemblies 80 can be readily removed from and reattached to chain 21 if necessary to relocate lug assemblies 80 when the envelope size is changed.

I claim:

1. A system for individually feeding envelopes from a stack of envelopes to a work station, comprising:

a hopper for holding a multitude of envelopes in flat stacked relationship with the flap edge of the envelope as the leading edge;

an elongated cylindrical feed roller located under the stacked envelopes in said hopper;

an elongated vacuum passageway along the axis of said feed roller;

a generally cylindrical vacuum drum coaxially mounted on said feed roller for rotational movement therewith in close proximity to the bottom envelope in said hopper, said drum having an interior vacuum chamber in vacuum communication with said roller vacuum passageway and a series of exterior vacuum outlet ports for applying vacuum to the lowermost envelope in the stack;

a vacuum source;

a vacuum source passageway coupling said vacuum source to one end of said roller vacuum passageway;

valve means in said vacuum source passageway operated by said feed roller, said valve means operable between an open condition and a closed condition as said feed roller reciprocably rotates between a first and a second position;

continuously moving carrier means;

means for reciprocably rotating said feed roller and said vacuum drum between a first position and a second position for withdrawing the bottom envelope from said hopper; and means for delivering each withdrawn envelope from said feed roller to said carrier means.

2. The envelope feeding system as described in claim 1 wherein said means for delivering the withdrawn envelopes to said carrier means includes: feeder wheel means rotatably mounted coaxially on said feed roller alongside said vacuum feed drum; and means for continuously rotating said feeder wheel means in a direction to advance each withdrawn envelope to said carrier means.

3. The envelope feeding system as described in claim 1 further including:

a pusher lug for contacting the trailing edge of the bottom envelope in said hopper; and means linking said pusher lug to said feed roller to reciprocably move said pusher lug for repetitively advancing the bottom envelope toward said carrier as said roller reciprocably rotates between said first and second positions.

4. The envelope feeding system as in claim 2 wherein said vacuum drum vacuum outlet ports include a series of axially spaced circumferentially elongated slots for applying vacuum suction to the withdrawn envelope from the first position to the second position of said vacuum drum.

5. The envelope feeding system as in claim 4 further including arcuate perforated skid plates alongside said feeder wheel means for slidably supporting each withdrawn envelope.

6. The envelope feeding system as in claim 3 wherein said means linking said pusher lug to said feed roller includes:

a slider bar;

arm means pivotably attached at one end to the exterior of said vacuum drum and pivotably attached at the other end to said slider bar; and means adjustably attaching said pusher lug to said slider bar.

7. The envelope feeding system as described in claim 1 wherein said carrier means comprises:

a pair of spaced-apart, endless, continuously moving link chains; and a series of carrier lugs mounted on each of said chains in spaced relation for moving each envelope delivered to the chains.

8. The envelope feeding system as described in claim 7 wherein each carrier lug comprises:

a flat base member attached to a link of one of the chains;

an upright post member attached to said base member; and a finger member pivotably attached to the next adjacent link on said chain for lifting the envelope away from said post member when said carrier chain reaches the end of its forward travel.

9. For use with a hopper containing a stack of envelopes, the envelopes arranged with the flap down and the flap edge as the leading edge and each envelope having a window area between the leading and trailing edges, a system for individually removing the envelopes from the hopper, comprising:

an elongated cylindrical feed roller located under the stacked envelopes in the hopper;

a generally cylindrical vacuum drum coaxially mounted on said feed roller for rotational movement therewith in close proximity to the bottom envelope in the hopper, said vacuum drum having an interior vacuum chamber and a series of exterior vacuum outlet ports for applying suction to the bottom envelope in the hopper;

means for reciprocably rotating said feed roller and said vacuum drum between a first position and a second position for withdrawing the bottom envelope from said hopper; and means for feeding vacuum to said drum chamber for applying suction to the bottom envelope while the drum moves from the first to the second position to pull the bottom envelope downward from the next envelope in the stack such that the edge of the window area of the bottom envelope avoids the edge of the flap of the next envelope in the stack.

* * * * *